US005921711A

United States Patent [19]

Sipaila

[11] Patent Number: 5,921,711

[45] Date of Patent: Jul. 13, 1999

[54] SUBSURFACE FLUID DISTRIBUTION APPARATUS AND METHOD

[76] Inventor: Jonas Z. Sipaila, 12955 Mahogany Dr., Reno, Nev. 89511-6217

[21] Appl. No.: 08/787,859

[22] Filed: Jan. 23, 1997

[51] Int. Cl.[6] ..... E02B 11/00

[52] U.S. Cl. ..... 405/45; 405/46; 405/49

[58] Field of Search ..... 405/49, 48, 47, 405/46, 45, 43, 36

[56] References Cited

U.S. PATENT DOCUMENTS

| | | | |
|---|---|---|---|
| 299,347 | 5/1884 | Chisolm | 405/48 |
| D. 329,684 | 9/1992 | Gray . | |
| 3,416,321 | 12/1968 | Saad et al. | 405/46 |
| 3,946,762 | 3/1976 | Green . | |
| 4,003,408 | 1/1977 | Turner . | |
| 4,094,466 | 6/1978 | DeRomano . | |
| 4,145,157 | 3/1979 | Lascelles | 405/43 |
| 4,188,154 | 2/1980 | Izatt | 405/43 |
| 4,192,628 | 3/1980 | Gorman . | |
| 4,402,631 | 9/1983 | Rosenthal . | |
| 4,538,377 | 9/1985 | Thornton . | |
| 4,740,104 | 4/1988 | Stöhr et al. . | |
| 4,759,661 | 7/1988 | Nichols et al. . | |
| 4,904,112 | 2/1990 | McDonald . | |
| 4,920,694 | 5/1990 | Higa . | |
| 4,950,103 | 8/1990 | Justice | 405/49 |
| 5,017,041 | 5/1991 | Nichols . | |
| 5,074,708 | 12/1991 | McCann, Sr. | 405/45 |
| 5,152,634 | 10/1992 | Maso . | |
| 5,156,488 | 10/1992 | Nichols . | |
| 5,294,212 | 3/1994 | Mehoudar . | |
| 5,383,744 | 1/1995 | Hendershot . | |

FOREIGN PATENT DOCUMENTS

| | | | |
|---|---|---|---|
| 8101580 | 6/1981 | WIPO | 405/48 |

*Primary Examiner*—Tamara Graysay
*Assistant Examiner*—Frederick L. Lagman
*Attorney, Agent, or Firm*—Kenehan Lambertsen & Stein; John C. Lambertsen

[57] ABSTRACT

A subsurface fluid distribution system for sewage effluent and irrigation water utilizes one or more arrays of serially connected leaching chambers. Each leaching chamber is a double-walled construction of arch-shaped cross section with an open bottom and closed ends. A plurality of vertically off-set openings are formed in the inner and outer walls, with the inner openings located at a higher liquid level than the outer openings to prevent clogging of the leaching chambers by either sand or root growth. The leaching chambers are connected to one another to permit fluid communication between adjacent chambers, and are installed below ground in shallow trenches that are backfilled with sand and then topped with top soil. The sewage effluent or irrigation water flows through the array of leaching chambers in an unpressurized flow. The even distribution of the fluid, both laterally and vertically, through the sand bed and then to the surrounding soil is enhanced by the capillary action properties of sand and the evapotranspiration effect provided by the overlying plant growth.

19 Claims, 3 Drawing Sheets

SUBSURFACE FLUID DISTRIBUTION APPARATUS AND METHOD

BACKGROUND OF THE INVENTION

1. Field of the Invention

The present invention relates to a subsurface fluid distribution system, and more particularly, to an underground array of interconnected leaching chambers that enable the unpressurized, subsurface dispersion of sewage and irrigation waters.

2. Description of the Prior Art

The underground treatment and dispersal of sewage effluent, as well as subsurface irrigation systems, require enhanced rates of water flow for maximum efficiency. Such flow rates can be achieved by either reliance on system pressurization or by attempting to enhance the efficiency of the more "natural" (and lower energy) processes such as diffusion, capillary action, and root-system absorption.

Turning first to sewage treatment, after initial processing within a septic tank, an effluent solution is discharged that includes partially-dissolved solids. Further bacterial action results in substantially complete dissolution of the solids, permitting its dispersal, with the liquid water, as the latter is absorbed into the surrounding soil. Most commonly this secondary treatment and dispersion is accomplished by passage of the effluent through a "leach line"—perforated piping placed within stone-filled trenches, and covered by a thin layer of top soil.

As a result of good initial reliability, plus statutory "encouragement" through sanitation regulations, the design specifications for leach lines has changed very little over the past sixty years, apart from occasional variations in physical dimensions and structural components. A trench is dug, and then partly filled with stone. A perforated pipe is laid on top of the stone, which is then covered by additional stone. A semi-permeable membrane such as building paper or a layer of straw is placed over the stones, followed by a topping layer of soil.

A typical leach line is twenty-four inches in width and eighteen inches in depth. While seemingly quite shallow, at eighteen inches sufficient oxygen is present in the soil to support aerobic microorganism decomposition. Such organisms and processes are considerably more efficient in breaking down the semi-solid sewage materials than is the decomposition that occurs in a deeper, anaerobic (no oxygen) environment. In addition, most soils are also less permeable to water as the soil depth increases. The increasingly compressed soil structure at greater soil depths results in slower rates of water flow through the soil, and less efficient dispersal of the sewage effluent along the leach line.

In addition to providing support for the distribution pipe, the stone fill in the leaching trenches increases the effective decomposition surface area and creates effluent storage volume within the trench. At three-quarter inch to one-and-a-half inches in diameter, Number "2" stone provides a sufficient number and size of void space to efficiently retain and distribute the sewage effluent throughout the leach line. One cubic foot of No. 2 stone provides a maximum of 3.25 gallons or 43% of the available storage volume for the sewage effluent. For a typical twenty-four inch wide by fifty-foot long leach line, this results in approximately 6.5 gallons per foot, or 325 gallons of effluent storage volume. In addition to providing capacity for surges in liquid flow, this pore or void volume also enhances the effective area for fluid dispersion at the soil-stone interface.

As initially installed, the effluent discharge surface area can be considered to be the "wetted" area of the sides and bottom of the stone-soil interface. At a preferred width of twenty-four inches, the resultant stone-soil interface consists of the bottom, twenty-four inch width and that lower "wetted" portion of the 2, twelve-inch side walls. Since the side walls provide equivalent absorbency to that of the bottom area, the fifty-fifty proportion of soil contact area, as between the twenty-four inch bottom width and the 2, twelve-inch side walls, maximizes the absorption efficiency between the leach line volume and the available soil contact area. Additionally, as the bottom stone layer becomes plugged (for reasons discussed below), an additional side wall surface area becomes available for liquid absorption as the liquid level rises in the leach line.

The final layer of the leach line consists of the top soil cover. A six-inch depth of soil represents a satisfactory compromise between providing pathogen-to-atmosphere separation as well as providing an optimal soil matrix for grass development. While a deeper top soil layer would beneficially increase the atmosphere-to-sewage separation distance, it would detrimentally decrease the evaporative loss rate from the leach line as well as result in the formation of an unstable layer of soil immediately above the semi-permeable membrane. Lying too deep to be stabilized by the grass roots, this layer of soil would tend to gradually silt into the stone-filled layer below, increasing an erosion problem that is inherent in stone-layer leach lines.

In addition to its often being costly to obtain and labor-intensive to install, stone fill is not a stable component of subsurface soil structure. The voids within the stone fill, while beneficial for liquid storage, are subject to a slow siltation process, whereby the surrounding soil gradually invades and fills these interstices. This slow collapse of the trench walls and ceiling into the stone voids reduces both the available pore space as well as the effective effluent discharge surface area. Further, this siltation process itself establishes subsurface liquid flow channels that tend to accelerate the siltation process. As one example, the gradual collapse of the trench walls and overlying soil of the original leach line creates a depression along the length of the leach line. Once formed, an increased volume and flow of surface rainwater is channeled into this depression, further accelerating the siltation of the surrounding soil into the stone bed.

In addition to siltation, the traditional stone-fill leach lines present other inherent steady-state operational problems. Typically, the perforated leach line pipe is four-inch (diameter) PVC pipe that passively delivers sewage effluent to the stone fill. The void spaces permit liquid sewage to flow throughout the field and, with no capillary action within the stone fill, the liquid sewage settles over time to occupy the lowest portions of the leach line.

Additional sewage effluent flowing into the field will then accumulate on top of the initial fluid flows. The passive stone fill leach line provides no active mechanism to either evenly distribute this sewage (horizontally) throughout the field or to draw the water upward (vertically), and thereby permit its interface with the upper soil portions of the trench. Over time, stagnation results and the lowest portions of the leach line trench become anaerobic. This further slows the decomposition of organic material in the lower sewage layer, as well as results in the production of incomplete decomposition by products (sludge) that plug up additional soil interface areas. With the lower portions of the trench no longer able to accept additional sewage flows, adding additional effluent only results in an increasingly deep anaerobic stagnant layer. The leach line slowly "dies".

Although ultimately susceptible to these siltation and/or stagnation processes, initially the leach line offers effective pathogen containment and waste water disposal by three separate mechanisms: (1) A reserve fluid storage capacity is provided by the stone voids; (2) The soil-stone interface establishes a mechanism for fluid absorption in the surrounding soil; and (3) Evapo-transpiration fluid loss is provided through the shallow construction and the grass root absorption.

There thus remains a need for a subsurface fluid distribution system having a reserve fluid storage capacity that, over time, maintains both fluid access to an active fluid/soil interface, for absorption into the surrounding soil, as well as an enhanced evapo-transpiration loss through the active absorption of the fluid by plant roots and a system that minimizes the negative attributes of siltation and stagnation.

In terms of optimized crop production and healthy plant growth, the critical factor for irrigation is the efficiency by which water is provided to the root zone area of the soil. For above-ground watering systems, before any benefit is realized by the growing plants the irrigation water must first enter the soil and then penetrate to the root zone. Wetting only the above-ground portions of the plant, or the layers of organic material and soil above the root zone is, at best, of no value. In fact, in many areas of the west such practices are harmful, in terms of mineral salt buildup.

Light, above-ground waterings encourage shallow rooting, resulting in plants that are less able to withstand periods without water. On the other end of the scale, heavy watering will frequently result in excessive amounts of water lost through evaporation and water run-off. Additionally, to avoid increased instances of plant disease, the timing of the watering is crucial, to avoid creating excessive above-ground plant moisture during the nighttime hours.

In an effort to avoid many of the forgoing problems, as well as the many maintenance problems associated with above-ground watering systems, underground irrigation has become increasingly popular. In theory such irrigation systems place the water almost directly into the root zone and eliminate water losses due to evaporation. Additionally, with the irrigation system substantially located below ground, all of the distribution pipes and delivery systems are protected from most forms of damage due to the movements of people and machinery.

Unfortunately, this subterranean location also makes it difficult to recognize when a problem in a system has first developed. Delivery heads or ports can become plugged, distribution lines break, and as a result, interrupt the delivery of water to the root zone, to the detriment of plant growth. Additionally, since most underground irrigation systems make use of pressurized and filtered water, breaks in the distribution lines can rapidly create severe subsurface erosion problems, as well as unwanted and sudden water losses. There thus exists a need for underground irrigation systems that rely on a passive water flow to distribute water evenly and consistently to the root zone areas of cultivated crops and turf grasses.

SUMMARY OF THE INVENTION

The present invention provides an enhanced subsurface fluid distribution system in a manner that avoids previous design deficiencies in both the known leach lines and irrigation systems. The storage capacity of the present invention makes use of one or more chambers instead of the stone fill voids, with such chambers providing enhanced stability in terms of fluid capacity over the siltation prone stone fill. With the sewage effluent distributed into the surrounding soil through such a chamber, the active soil interface area for absorption of the fluid is more than doubled.

Additionally, these chambers are received within a sand bed, which itself provides an exceedingly active capillary action mechanism to withdraw water from the chambers. Moreover, this sand bed provides an excellent medium for supporting root growth, which in turn enables an increase in the evapo-transpiration rate by a full order of magnitude. Also, this sand envelope virtually eliminates siltation as a problem by preventing soil incursion into the sand bed, which otherwise comprises a stable underground soil formation. The capillary action provided by the surrounding sand bed not only distributes the sewage effluent evenly, both laterally and vertically, but also enables the quick dewatering of the sewage effluent. Unlike the stagnant fluid found in the lower layer of stone-filled leach lines, the resulting dewatered leach line of the present invention enhances oxygen availability to the sewage solids—and therefore of aerobic microorganism activity. This greatly speeds the decomposition of the organic matter remaining after transport of the water from the chamber.

The adaptability of the present invention to effectively distribute fluids to the growing region or "root zone" of leach line grass can advantageously be used to provide an ideal subsurface irrigation system for any type of plant. Unlike known subsurface irrigation systems that rely on pressurized and filtered water, the water distribution system of the present invention utilizes a non-pressurized, passive water system of either filtered or unfiltered water to provide even and unobstructed fluid distribution. The ability and flexibility of the present invention for installation in varied terrain and, with slight modifications, in all types of soil environments greatly expands the ability to grow plants in many previously hostile environments.

By utilizing a capillary-driven delivery system accorded by the sand bed, the root zone remains damp but not super-saturated with the irrigation water. This characteristic eliminates the possibility of either over- or under-watering a growing plant. Additionally, since water is being provided directly to the root zone, the actual amount of water usage is minimal, in comparison to the water required for above-ground irrigation. The elimination of this water waste results in significant irrigation efficiencies. In controlled experiments, the water distribution system of the present invention used only 31% of the water required by a conventional, surface sprinkler system, and only 62% of the water used by a present, state-of-the-art drip irrigation system.

The fluid distribution system according to the present invention comprises a chamber of a predetermined length, preferably having a dome-shaped cross section, an inner shell spaced from an outer shell, and a bottom open to a supporting surface. The outer shell of the chamber is provided with a plurality of outer ports, spaced along the length of the chamber and located proximate to the chamber bottom. The inner shell of the chamber has a corresponding plurality of inner ports that are vertically offset with respect to the outer ports, and are located along the length of the chamber. End closure panels are also provided the chamber, each of which panels preferably are provided with an opening appropriately sized to receive a fluid transfer pipe for the inflow and discharge of fluid with respect to the chamber.

The fluid distribution system of the present invention comprises a fluid source and at least one, and preferably a plurality of, chambers as described above. When said plurality of chambers are used, each of such chambers is serially connected to adjacent chambers in a manner permitting the sequential flow of fluid from chamber to chamber when the fluid reaches a predetermined depth in an upstream chamber. The movement of fluid from chamber to chamber is an unpressurized flow, in response to fluid levels within adjacent chambers.

Concurrently with the fluid flow from chamber to chamber, fluid is being discharged from each of said fluid-filled chambers through the plurality of lateral openings formed therein. The rate of fluid flow through such lateral openings is dependent upon the rate at which the adjoining soil can transport such fluid away from the lateral openings. In the present invention, such adjoining soil is a sand bed, and an enhanced rate of fluid flow is achieved as a result of the capillary-enhanced fluid dispersion rate through beds of sand. The flow of fluid within the sand bed is further enhanced by the ability of plant roots to readily penetrate and be supported by the sand bed, permitting a further enhanced rate of fluid flow as a result of evapo-transpiration through the plants growing within the sand bed.

The method of distributing fluid in accordance with the present invention comprises the steps of excavating a plurality of trenches of a predetermined depth and width, in an area selected for the distribution of said fluid. A predetermined length of each trench is then leveled and a chamber as described above is placed therein. A sequential series of level sections and located chambers are then placed within the trenches, with adjoining chambers connected and the penultimate chamber of each trench connected to a first chamber in an adjoining trench.

Each trench containing said placed and connected chambers is then filled with sand to a predetermined depth, covering such chambers, with the remaining portion of the excavated trench then covered with top soil of an appropriate depth, to stabilize the sand bed and provide a suitably receptive medium to encourage plant growth. The sand bed surrounding the placed chambers provides for the stable interface of fluids from the chamber and, through capillary action, to the surrounding soil. The sand bed also provides the structural support to the chambers required to withstand pressure exerted by the surrounding soil, as well as any pressure applied due to surface activities. The offset openings located between the inner and outer shell of each of the chambers uniquely prevents either sand or root infiltration into the chamber, thereby preventing the blockage thereof.

Other objects, features, and advantages of the present invention will be apparent to those of ordinary skill in the art from the following description of the preferred embodiments, as illustrated in the accompanying drawings.

DESCRIPTION OF THE PREFERRED EMBODIMENTS

Figure 1:
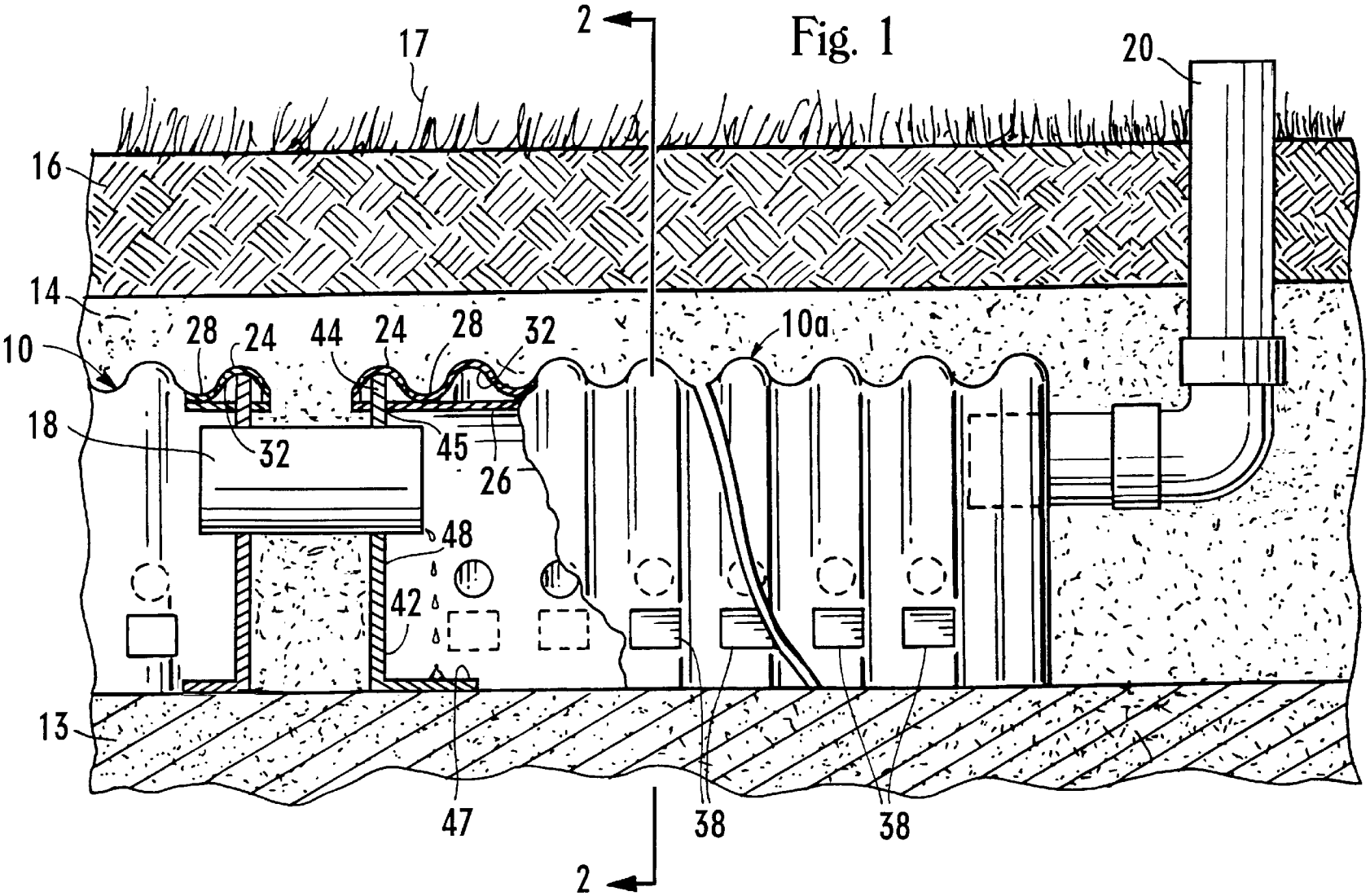
FIG. 1 is a partial side elevation view, with portions broken away, portions in section, and portions in phantom, showing a fluid distribution system of the present invention as placed within the earth.

Reference is now made to the drawings wherein like numerals refer to like parts throughout. In FIG. 1, a pair of leaching chambers 10 are shown resting upon a soil bed 13 and received within a sand bed 14. A top soil layer 16 covers the sand bed 14 and provides a growth matrix for a covering plant 17, such as a grass shown in FIG. 1. A connector pipe 18 permits fluid communication between the adjacent leaching chambers 10, with a vent pipe 20 provided for fluid communication between the interior portions of the leaching chamber 10 and the atmosphere.

Each of the leaching chambers 10 consist of an open-bottom, two-walled construction that is arch-shaped in cross section. A corrugated outer shell 24 is attached to a smooth-walled, inner shell 26 at a plurality of attachment arches 28. The corrugated outer shell 24 exhibits a repeating outer pattern of peak corrugations and valley corrugations (ridges and grooves), with the attachment arches 28 defined by the attachment of the inner shell 26 to the outer shell 24 at each of the groove or valley corrugation locations. A plurality of vaulted chambers 32 are likewise formed between the inner shell 26 and the outer shell 24 at locations that correspond to each of the ridge or peak corrugations formed in the outer shell 24. As so located, the attachment arches 28 and the vaulted chambers 32 alternate with one another as determined by the corrugation pattern of the outer shell 24.

The inner shell 26 is provided with a plurality of inner shell apertures 36 formed therein and located a predetermined distance from the base thereof. Each of the inner shell apertures 36 is so located as to provide fluid communication between a separate one of the vaulted chambers 32 and the interior of the leaching chamber 10.

In a like manner, the outer shell 24 is provided with a plurality of outer shell apertures 38 formed therein, with the outer shell apertures 38 corresponding in number to the inner shell apertures 36, but vertically offset therefrom, in a manner such that the outer shell apertures 38 are located closer to the base of the leaching chamber 10. As so located, channels for fluid communication are established between the interior portions of the leaching chamber 10 and the outer, sand bed 14. With the inner shell apertures 36 located at a greater liquid level l than a liquid level l of the outer apertures 38 (see FIG. 2), the fluid accumulates within the leaching chamber 10 until the liquid level reaches the inner shell apertures 36. Fluid then flows into the vaulted chambers 32, and the exits through the lower, offset, outer shell apertures 38.

A pair of end panels 42 complete the outer structure of the leaching chamber 10, with each one of the end panels 42 located and closing off a separate end of the leaching chamber 10. In a particularly preferred embodiment, the end panels 42 are sized such that an outer edge 44 of the end panel 42 is received within a receiving slot 45 formed in the inner shell 26, at a location permitting the outer edge 44 to extend into and be received by the vaulted chamber 32. In this manner, the interface between the inner shell 26 and the end panel 42 forms a fluid and sand seal, preventing leakage of fluid from within the chamber 10 past the end panels 42, and sand infiltration into the interior of the chamber 10.

The extended footing 47 both reduces the opportunity for erosion at the base of the end panels 42, as well as functioning as a splash panel for fluid dropping from the connector pipe 18 (see FIG. 1). A connector-receiving aperture 48 is formed in each of the end panels 42 of a size sufficient to receive the connector pipe 18, which permits fluid communication between the interiors of the adjoining pair of leaching chambers 10, 10*a*.

The flow of fluids into the second or adjoining leaching chamber 10*a*, and its subsequent distribution thereafter into the surrounding soil, is best described by reference to FIG. 2. A fluid 51, such as a sewage effluent or irrigation water, is shown entering the leaching chamber 10*a* through the connector pipe 18. As depicted in FIG. 1, this flow occurs only after the fluid 51 has first accumulated to a sufficient depth in the preceding leaching chamber 10 as to permit its entry into the connector pipe 18.

So long as the fluid 51 remains at the flow-over depth in the first leaching chamber 10, any additional flow of the fluid 51 into the first chamber 10 will result in a continuing flow of the fluid 51 into the second leaching chamber 10*a*. Comprising a vessel defined by the inner shell 26, the end panels 42, and the soil bed 16, to the extent that this inflow rate of the fluid 51 exceeds the rate of fluid diffusion into the soil bed 16 (outflow), fluid will accumulate within the second leaching chamber 10*a*.

Eventually, the fluid level reaches the lower edge of inner shell apertures 36 of the second chamber 10*a*. Any additional accumulation results in the fluid level rising above the lower edge of the inner shell aperture 36, which initiates the flow of the fluid 51 into the vaulted chambers 32. Since the volume of the vaulted chambers 32 is significantly less than the volume of the inner shell 26, the fluid 51 will rapidly accumulate and fill the vaulted chamber 32, rising therein until reaching the level of the outer shell apertures 38. Thereafter, any further flow of the fluid 51 into the vaulted chamber 32 will result in the discharge of the fluid 51, through the outer shell apertures 38, into the surrounding sand bed 14. Concurrently, while the sand 14 can readily infiltrate the lower portion of the vaulted chamber 32, the vertically offset opening 36 in the inner chamber wall 26 prevents sand infiltration into the primary leaching chamber 10.

Figure 2:
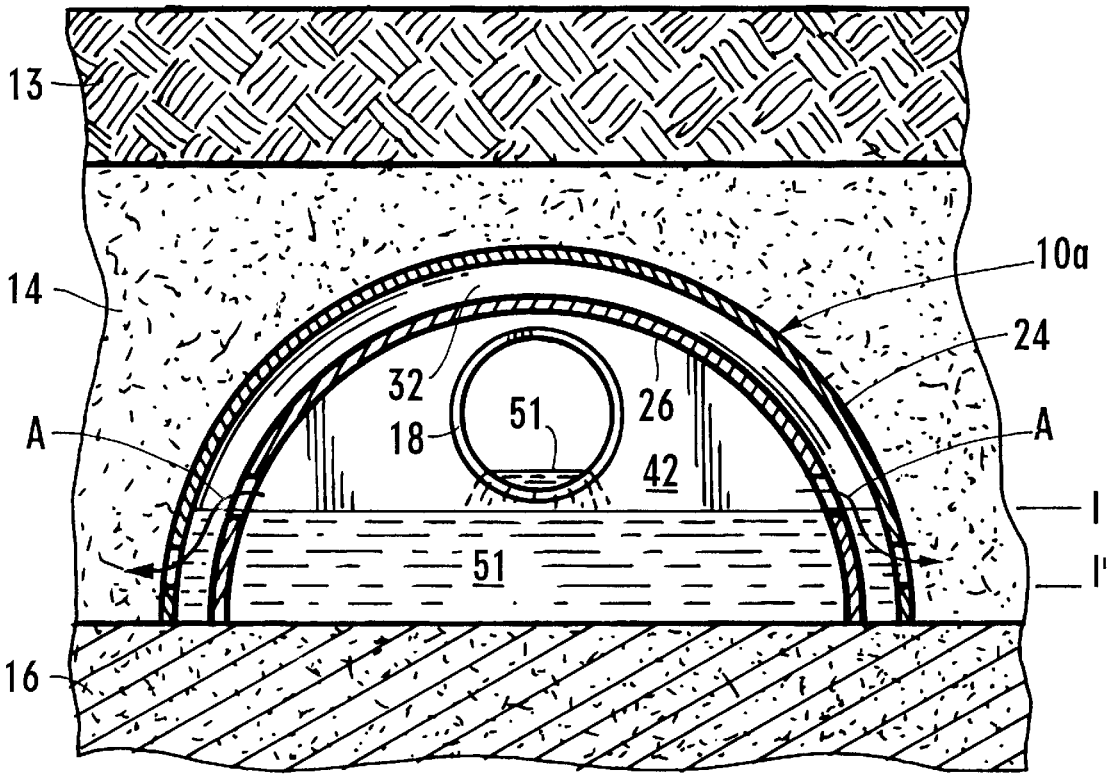
FIG. 2 is a cross-sectional view taken along line 2—2 of FIG. 1, showing the fluid distribution system of the present invention in situ within the earth.

This fluid flow is depicted in FIG. 2 by arrows A, and by taking advantage of the liquid absorption properties of sand, this flow of fluids from the leaching chamber 10*a* is rapidly disbursed into the surrounding sand bed 14. Favorable properties of both diffusion and capillary action cause the fluid to be continuously removed from the discharge area surrounding the leaching chamber 10*a*. In the event that the flow of the fluid 51 from the leaching chamber 10*a* continues at a rate that is greater than the rate of fluid diffusion into the soil bed 16 and the sand bed 14, the fluid level continues to rise within the second chamber 10*a* until it reaches a level that is co-extensive with the bottom of the connector pipe 18. In a manner similar to that occurring in the first chamber 10, the fluid 51 will then flow from the second leaching chamber 10*a* into the next, succeeding leaching chamber 10*b* (not shown in the Figures).

In this manner a serial sequence of leaching chambers is in fluid communication with one another, with the connector pipes 18 distributing the fluid 51 throughout one or more leaching beds. By providing an appropriate number of leaching chambers for the anticipated fluid flow rates, the fluid level in any one leaching chamber will not exceed beyond the level of the connector pipe. This maintains an air passageway throughout each of the connected leaching chambers, permitting a continued flow of air, which is then vented through vent pipe 20 (shown in FIG. 1). This airflow is crucial to both removing decomposition gasses within the chambers, as well as maintaining sufficient levels of oxygen to obtain aerobic decomposition of any entrained sewage solids.

Figure 3:
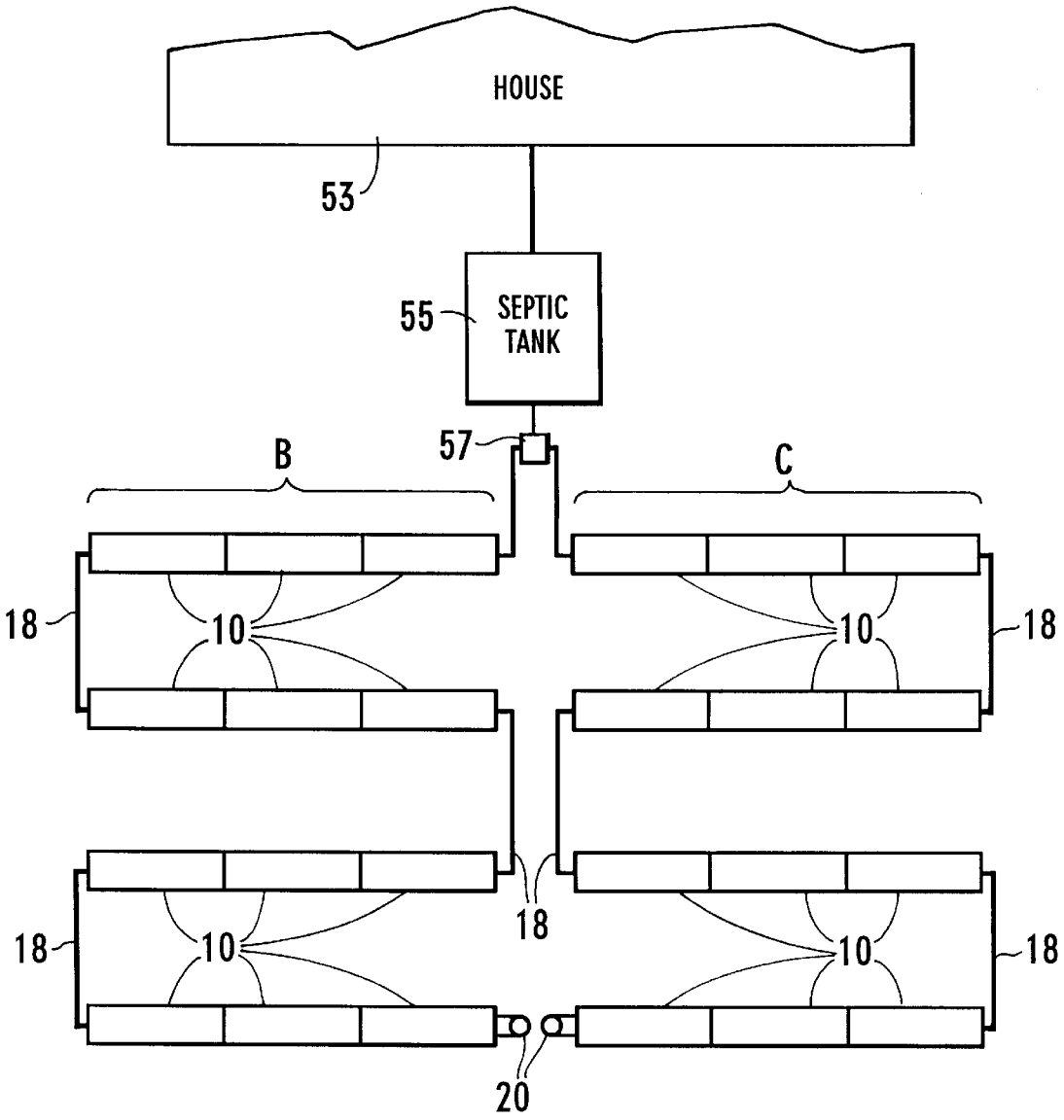
FIG. 3 is a diagrammatic view showing a residential leaching field constructed in accordance with the present invention.

Turning now to FIG. 3, a leaching chamber system in accordance with the present invention is diagrammatically displayed in the context of domestic sewage treatment. Sewage and other liquid wastes generated within a domicile 53 flow into an initial collection and treatment container 55, identified in FIG. 3 as a "septic tank". Within the treatment container 55 bacteria begin the initial decomposition of the sewage, breaking down the organic solid materials. After a sufficient residence time, fluid comprising water with entrained dissolved and suspended semi-solids flows from the treatment container 55 and to a switch valve 57.

Further decomposition of the semi-solid sewage wastes occurs within the leaching chambers 10. To enhance the efficiency of an overall domestic sewage treatment system, it is preferred that the leaching chambers be serially arranged in two separate arrays. In FIG. 3, such an arrangement is depicted as a first array B and a second array C.

The direction of flow of the fluid leaving the treatment container 55 is determined by the position of the switch valve 57, into either the array B or the array C. In the context of septic tank systems, the array to which the fluid is directed is known as the "active field" and the "non-active" array, which is not receiving the septic tank fluid, is known as the "resting field". In a typical installation utilizing the leaching chambers of the present invention, the switch valve 57 is activated to change the fluid flow into the respective arrays approximately every six to twelve (6–12) months. A variety of factors can affect the timing as to how long a particular field remains "active," including such factors as surge usage, weather, ambient soil temperature, dewatering rate, etc.

Once the partially treated effluent flows through the switch valve 57 and into an array of leaching chambers 10, the flow within each of these leaching chambers proceeds as has been previously described. As a preceding leaching chamber reaches a saturated fluid level, the next succeeding or adjoining leaching chamber receives the overflow fluid. With the entire system unpressurized and open to ambient air, the flow of refreshing air directed through the leaching chamber enhances the rate and extent of sewage decomposition. This airflow is ultimately vented to the atmosphere through the vent pipes 20.

For a properly designed system, all of the fluid entering the leaching chamber array will have been dispersed into the soil surrounding the leaching beds before reaching the final leaching chamber of the array. In such systems, at the normally-anticipated sewage effluent flow rates the last several leaching chambers will seldom receive any significant fluid flow.

Figure 4:
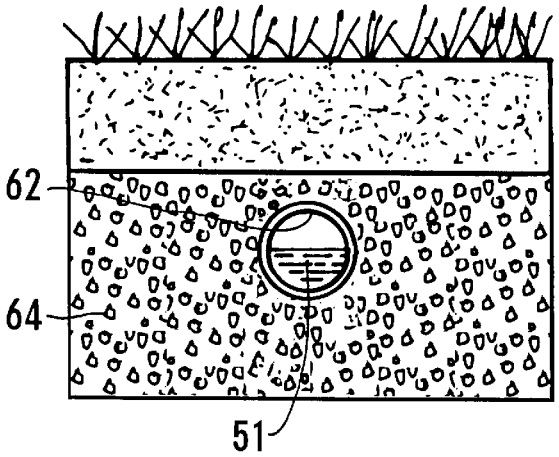
Fig. 4 (PRIOR ART)
FIG. 4 is a cross-sectional view, similar to FIG. 2, showing a stone-fill leach line as known to the prior art.

The leaching chamber structure and resultant fluid flow patterns described in accordance with the present invention significantly differ from those of the prior art. With reference to FIG. 4, a perforated leach line 62 is shown located within a stone fill bed 64. As previously described, the effluent fluid 51 within the perforated leach line 62 flows out into the stone fill bed 64. The stones within the stone fill bed 64 form a supportive matrix for the leach line 62, while the void space located between such stones comprises a containment space able to accept the fluid discharged from the leach line 62.

Such void space is too large to support any capillary induced fluid movement, and thus fluid flowing from the leach line 62 flows to the bottom of, and gradually accumulates within, the stone fill 64. Any field discharge from the stone fill bed is limited to the amount of fluid that can be absorbed by the surrounding soil through either the base of the stone fill bed or along the sides of the stone fill, up to the level of the fluid within the bed. As noted previously, the gradual siltation of the surrounding soil into the stone fill will, over time, significantly reduce the efficiency of stone fill leach lines.

Figure 5:
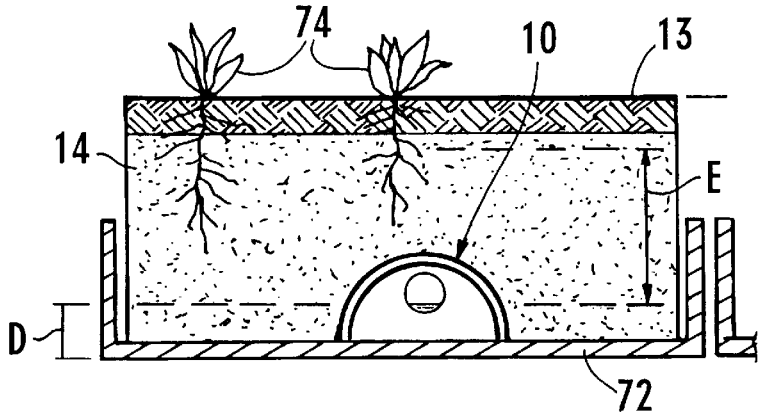
FIG. 5 is a cross-sectional view, similar to FIG. 2, showing use of the present invention in an irrigation application, with an underlying impermeable liner provided to prevent water loss to subsurface soils.

Turning now to FIG. 5, use of the leaching chambers in accordance with the present invention is shown in the context of a subsurface irrigation system. In such a system it is desirable to maximize the amount of water available to the plants while minimizing the subsurface loss of water. In some areas clay soils will serve to limit such water loss. Otherwise, where such loss of water would be significant, the leaching chamber 10 is placed upon a water containment liner or box 72. The system is otherwise set up in a manner similar to that previously discussed, and when water begins to flow from the leaching chamber 10 and into the sand bed 14, the containment liner 72 prevents its escape into the lower soil layers. Instead, the water accumulates in the bottom of portion of the sand bed, to form a wet zone of depth D.

Under steady state conditions, the depth of this wet zone D is substantially equal to the depth of fluid within the leaching chamber 10. Above this wet zone is a dampened, capillary zone denoted by reference letter E. The overlying top soil layer 13 is of a sufficient depth such that roots from plants forming an irrigated crop 74 extend into the capillary zone E of the sand bed 14. Due to the advantageous use made of the ability of sand to transport water through capillary action, the capillary zone E is continuously dampened through the upward flow of water from the wet zone.

This advantageously permits the transpiration rate of the plant itself to regulate the flow of water from the irrigation water provided by the leaching chambers 10 into the capillary zone E. The irrigated crop plants 74 are thereby provided, on a continuous basis, with an appropriate amount of water that is gauged by the specific water requirements of each individual plant. Of course these stress levels can vary on a day-to-day basis due to environmental factors as well as in response to the stage of maturity for the particular plant. Water needs are dictated by the plant itself and not by arbitrary application rates.

While the invention has been particularly shown and described with reference to a preferred embodiment thereof, it should be understood by those skilled in the art that changes in form and detail may be made therein without departing from the spirit and scope of the present invention. Presently, the preferred embodiment is a modification of a currently available, double-walled plastic drainage pipe distributed by Advanced Drainage Systems, Inc., of Columbus, Ohio.

As presently constructed, a twelve inch diameter pipe is cut in half, lengthwise, in ten-foot segments, with end panels thereafter installed in each end. The various inner shell apertures and outer shell apertures are then cut into the inner and outer walls of the drainage pipe, completing the formation of the leaching chambers. The aperture formed in the end panels is designed to be of a diameter that is slightly larger than the connector pipe, which itself can be either two or four inches in diameter. The outer shell apertures are preferably rectangular in shape, and approximately one inch vertically and one inch horizontally, and are located approximately one inch from the bottom of the outer shell. The inner apertures are circular in shape, one inch in diameter, and are located approximately two inches from the bottom of the inner shell. As a result, the inner and outer apertures are spaced approximately one-and-a-half inches apart, on center, and are vertically offset approximately 1–1½ inches.

The installation of the leaching chambers in accordance with the present invention is initiated by the excavation of a series of trenches, fourteen to eighteen inches deep and eighteen to forty-eight inches wide. The length and width of the trenches will vary, depending upon the design requirements for the particular leaching bed. At a minimum, an excavated section of length ten feet is leveled, and if downward leaching of water is not desired, water impermeable liners or enclosing boxes are installed in the leveled trench. Thereafter a series of leaching chambers are placed within the trench, and laid end-to-end so that the lateral leaching chamber water discharge apertures are substantially aligned. The leaching chambers are then connected to one another utilizing the end panel connector pipes.

A layer of sand is then back-filled over the leaching chambers. Since the upward capillary draw of most sands exceeds a ten-inch vertical above the waterline, a preferred depth of the fill sand over the leaching chambers is approximately twelve inches from the trench bed. The present invention can make use of sands of varying coarseness, with a sand coarseness of 0.3 mm to 0.6 mm grain size being viewed as particularly appropriate.

Finally, the sand layer is covered with excavated dirt or top soil to a depth of between approximately four to six inches. Because of the arched cross-section of the outer shell 24, the leaching chambers 10 are sufficiently strong to withstand the weight of vehicles on top of the replaced soil. Additionally, the individual settling of the leaching chambers within the trenches will not cause a break in the sand seal of the system, since the connector pipes 18 are self-adjusting.

Depending upon the slope of the particular terrain, several different arrangements of the leaching chamber arrays are possible. The system depicted in FIG. 3 is but one possible arrangement. Since the leaching chamber units act independently throughout their (preferred) ten foot length, on sloping terrain the trenches are preferably excavated level along the slope contours. The "adjacent" leaching chambers can then be connected perpendicularly across the slope contours, with such adjacent leaching chambers located on different vertical levels, utilizing longer connector pipes where required.

My invention has been disclosed in terms of a preferred embodiment thereof, which provides an improved subterranean fluid distribution system of great novelty and utility. Various changes, modifications, and alterations in the teachings of the present invention may be contemplated by those skilled in the art without departing from the intended spirit and scope thereof. It is intended that the present invention encompass such changes and modifications.

I claim:

1. A subsurface fluid distribution chamber comprising:

an enclosure having an inlet opening and a discharge opening formed therein, at least a portion of said enclosure comprising a two-walled structure that comprises:

an outer shell having a plurality of apertures formed along a first lateral portion thereof, an inner shell, attached to said outer shell in a spaced-apart manner, said inner shell having a plurality of inner shell apertures formed along a first lateral portion thereof, wherein said inner shell apertures define, relative to said enclosure, a liquid level that is greater than a liquid level defined by said outer shell apertures, and wherein each of said plurality of outer shell apertures is of a size enabling the formation of an infiltrated particulate bed adjacent said outer shell apertures, said infiltrated bed at a level substantially equal to said liquid level defined by said outer shell apertures.

2. A fluid distribution chamber according to claim 1, wherein said outer shell apertures and said inner shell apertures are located proximate to one another, with said inner shell apertures vertically off-set from said outer shell apertures.

3. A fluid distribution chamber according to claim 2, wherein said inner shell apertures define, relative to said enclosure, a liquid level that is greater than a liquid level defined by said outer shell apertures.

4. A subsurface fluid distribution chamber comprising:

an enclosure having an inlet opening and a discharge opening formed therein, at least a portion of said enclosure comprising a two-walled structure that comprises:

an outer shell having a plurality of apertures formed along a first lateral portion thereof, and an inner shell, attached to said outer shell in a spaced-apart manner, said inner shell having a plurality of inner shell apertures formed along a first lateral portion thereof, wherein said two-walled structure comprised of said outer and inner shells has an arch-shaped cross-section having opposing open ends and no floor, and said enclosure further comprises:

a pair of end panels, each of said end panels sized to be received by and form a sealed relationship with said two-walled structure at respective ones of said opposing open ends, and wherein said outer shell apertures and said inner shell apertures and said inner shell apertures are located proximate to one another, with said inner shell apertures vertically off-set from said outer shell apertures, said inner shell apertures define, relative to said enclosure, a liquid level that is greater than a liquid level defined by said outer shell apertures.

5. A fluid distribution chamber according to claim 4, wherein one of said end panels has an inlet opening formed therein and the other of said end panels has an outlet opening formed therein.

6. A fluid distribution chamber according to claim 4, wherein said outer shell defines a corrugated surface, having alternating peak corrugations and valley corrugations.

7. A fluid distribution chamber according to claim 6, wherein said inner shell is attached to said outer shell at one or more of said valley corrugations and wherein said inner shell and said outer shell together define a vaulted chamber at each of said peak corrugations in said outer shell.

8. A fluid distribution chamber according to claim 7, wherein both said inner shell apertures and said outer shell apertures are co-located in one or more of said vaulted chambers.

9. A fluid distribution chamber according to claim 8, wherein both said outer shell and said inner shell have an additional plurality of apertures formed along a second lateral portion of each respective shell, and wherein each of said vaulted chambers has formed therein an aperture from each of said first and said second lateral portions for each of said outer and said inner shells.

10. A distribution system particularly adapted for the dispersion of fluid below the surface of the ground, comprising:

a chamber defined by an inner shell spaced from and attached to an outer shell, said outer shell defining a corrugated surface, having alternating peak corrugations and valley corrugations, and wherein said inner shell is attached to said outer shell at one or more of said valley corrugations, said inner shell and said outer shell together defining a vaulted chamber at each of said peak corrugations in said outer shell, both said inner shell and said outer shell having a plurality of apertures formed therein along lateral portions thereof, said plurality of inner shell apertures and said plurality of outer shell apertures co-located in one or more of said vaulted chambers, each of said vaulted chambers forming a channel for fluid communication between an interior portion of said chamber and an exterior environment of said chamber, an inlet pipe attached to said chamber and in fluid communication with said interior portion of said chamber, and an outlet pipe attached to said chamber and in fluid communication with said interior portion of said chamber.

11. A distribution system particularly adapted for the dispersion of fluid below the surface of the ground, comprising:

a chamber defined by an inner shell spaced from and attached to an outer shell, both said inner shell and said outer shell having a plurality of apertures formed therein along lateral portions thereof, said plurality of apertures forming channels for fluid communication between an interior portion of said chamber and an exterior environment of said chamber, an inlet pipe attached to said chamber and in fluid communication with said interior portion of said chamber, and an outlet pipe attached to said chamber and in fluid communication with said interior portion of said chamber, wherein said chamber is arch-shaped in cross-section, having a pair of open ends and an open bottom, and wherein said plurality of apertures in said inner shell are at locations linearly proximate to and vertically off-set from said plurality of apertures in said outer shell, said distribution system further comprising:

a pair of end panels, each of said end panels received within and forming a sealed relationship with one of said pair of open ends of said chamber.

12. A distribution system as described in claim 11, wherein each of said end panels has a pipe-receiving aperture formed therein of dimensions suitable for receiving said inlet pipe in one of said end panels and said outlet pipe in the other of said pair of end panels.

13. A distribution system as described in claim 12, wherein a pair of chambers are provided, with said pair of chambers attached to and in fluid communication with one another.

14. A distribution system as described in claim 13, wherein said outlet pipe of one of said pair of chambers is received by and comprises an inlet pipe of the other of said pair of chambers.

15. A distribution system as described in claim 12, wherein a plurality of chambers are provided with a first portion of said plurality of chambers forming a first array and a second portion of said plurality of chambers forming a second array.

16. A distribution system as described in claim 15, wherein each of said chambers of said first and said second arrays are serially arranged, with each of said chambers in said first array in fluid communication with one another, and each of said chambers in said second array in fluid communication with one another.

17. A method for the subsurface distribution of a fluid, comprising:

excavating a trench having a predetermined width and depth;

leveling selected sections within said excavated trench;

mounting a double-walled chamber on one or more of said leveled sections, said double-walled chamber having an open bottom and provided with vertically off-set apertures formed in lateral portions thereof in each of said walls of said chamber, wherein said inner shell apertures define, relative to said enclosure, a liquid level that is greater than a liquid level defined by said outer shell apertures, and wherein each of said plurality of outer shell apertures is of a size enabling the formation of an infiltrated particulate bed adjacent said outer shell apertures, said infiltrated bed at a level substantially equal to said liquid level defined by said outer shell apertures;

connecting each of said double-walled chambers in a manner permitting fluid communication therebetween, wherein said connecting step results in the serial connection of said double-walled chambers;

backfilling said trench with sand to a depth that, at a minimum, covers said lateral portions of said double-walled chamber having said apertures formed therein; and topping said backfilled sand layer with a layer of top soil.

18. A method for subsurface distribution of a fluid as described in claim 17, and further comprising the step of:

connecting said serially-connected, double-walled chambers to a source of partially treated sewage effluent.

19. A method for subsurface distribution of a fluid as described in claim 17, and further comprising the step of:

connecting said serially-connected, double-walled chambers to a source of irrigation water.

* * * * *